US007635022B2

(12) United States Patent
Han et al.

(10) Patent No.: US 7,635,022 B2
(45) Date of Patent: Dec. 22, 2009

(54) PUMPING SYSTEM

(75) Inventors: Xiuting Han, Daqing (CN); Huanzhong Dong, Daqing (CN); Jiamin Zhang, Daqing (CN); Shuhua Wang, Daqing (CN); Fengyou Chen, Daqing (CN); Aiguo Mo, Daqing (CN)

(73) Assignees: Petrochina Company Limited, Beijing (CN); Daqing Oilfield Company Limited, Daqing Heilongjiang Province (CN)

( * ) Notice: Subject to any disclaimer, the term of this patent is extended or adjusted under 35 U.S.C. 154(b) by 104 days.

(21) Appl. No.: 11/585,758

(22) Filed: Oct. 24, 2006

(65) Prior Publication Data

US 2007/0098575 A1 May 3, 2007

(30) Foreign Application Priority Data

Oct. 28, 2005 (CN) ..... 2005 1 0116731

(51) Int. Cl.
*E21B 43/00* (2006.01)
*F04B 17/00* (2006.01)
*E21B 4/04* (2006.01)

(52) U.S. Cl. ..... 166/65.1; 166/68.5; 166/66.4; 417/415; 417/410.1

(58) Field of Classification Search ..... 166/65.1, 166/68.5; 417/415, 410
See application file for complete search history.

(56) References Cited

U.S. PATENT DOCUMENTS 2,370,029 A * 2/1945 Gayle ..... 74/89.2
2,438,298 A * 3/1948 Reed ..... 198/700
3,153,387 A * 10/1964 Sadouet ..... 92/130 R
4,052,907 A * 10/1977 Chardonneau et al. ..... 74/89.22
4,456,060 A * 6/1984 Stanton ..... 166/68.5
4,601,640 A * 7/1986 Sommer ..... 417/12
4,693,171 A * 9/1987 Dollison ..... 91/216 B
4,761,120 A * 8/1988 Mayer et al. ..... 417/403
5,375,657 A * 12/1994 Shi et al. ..... 166/68.5
2003/0010491 A1 * 1/2003 Collette ..... 166/65.1
2004/0144529 A1 * 7/2004 Barnes et al. ..... 166/53

* cited by examiner

*Primary Examiner*—Jennifer H Gay
*Assistant Examiner*—Yong-Suk Ro
(74) *Attorney, Agent, or Firm*—David Silverstein; Andover-IP-Law

(57) ABSTRACT

A pumping system is described comprising a bracket being vertically fixed onto the connection end of a pump basement and also connected to a wellhead in order to support multiple fixed pulleys fixed on the same plane as the top end of the bracket), an electric motor and a speed reducer also successively being fixed to a lower end of the bracket. The end head of an output shaft of a speed reducer is connected by means of a crank whose top end head is connected with a movable pulley that is on the same plane as the fixed pulleys. A flexible cable vertically hung in the center of the wellhead is successively wound across the fixed pulleys and the movable pulley and then is locked onto the pump basement. The flexible cable is downwardly connected to a plunger element of an upper wellhead canned pump and also to a plunger element of a downhole oil well pump. This pumping system is characterized by good movement performance, high level of effective load factor, the ability to use the combination of its own driving power and special tools for complementing the characteristics of low power consumption on tripping the plunger of oil well pump, as well as relatively small dimension and low weight of the pumping system relative to conventional oilfield pumping units.

20 Claims, 2 Drawing Sheets

PUMPING SYSTEM

CROSS-REFERENCE TO RELATED APPLICATIONS

This application claims priority to Chinese patent application Ser. No. 2005-10116731.3 filed Oct. 28, 2005.

FIELD OF THE INVENTION

This invention relates generally to a lift or pumping system used, for example, in the field of oilfield production, and more particularly to an oilfield pumping apparatus.

BACKGROUND OF THE INVENTION

As the development of oilfield and related technologies has progressed, a wide variety of artificial lift or pumping equipment has become available. Such equipment ranges from the beam pumping unit to the submersible electric pump, screw pumps, and other specially designed devices in order to adapt to the equipment required for different production stages. Currently, the pumping unit most commonly used for artificial lift in oil production is the beam pumping unit. Based on the structural differences in the crank four-bar mechanisms of the horsehead, beam pumping units can be classified into conventional beam pumping units, back-crank pumping units, out-of-phase beam pumping units, and dual horsehead beam pumping units. Such conventional pumping units of the abovementioned structures and models are typically characterized by inferior movement performance, low level of effective load factors, and high power consumption. Also, because these conventional pumping units generally have large dimensions and relatively high weights, they need robust foundations and therefore relatively high capital investments. Furthermore, the labor intensity involved in carrying out periodic parameter adjustments and balance adjustments is relatively high.

SUMMARY OF THE INVENTION

In order to overcome such disadvantages of conventional pumping units as inferior movement performance, low level of effective load factors, high power consumption, large dimensions, high weights, high capital investments, high operating costs, and high labor intensity in parameter adjustments and testing, the present invention provides a pumping system that not only operates with good movement performance, high level of effective load factor, and low power consumption, but also features relatively small dimensions and low weight of the unit, less capital investment, relative ease of parameter adjustments and testing operations, and the elimination of rigid rods. Further, the pumping unit of the present invention is a multifunctional pumping system that has multiple pumping, operating and testing capabilities, and does not need special operational derricks and rigs during operations to replace the plunger, but rather can execute tripping operations by using its own driving power.

The pumping system of the present invention generally comprises an electric motor and a pump basement or base unit, characterized at least in part by the following features: a bracket is vertically fixed on the side of the basement that is connected to the wellhead; a fixed pulley is fixed on the same plane as the top end of the bracket; the electric motor and a speed reducer are successively fixed on the other end of the bracket; the end head of the output shaft of the speed reducer is connected to a crank; the top end head of the crank is connected with one or more movable pulleys that are on the same plane as the fixed pulley; and a flexible driving element vertically hung in the center of the wellhead is successively wound across the fixed pulley, the movable pulleys, and another fixed pulley before then being locked onto the basement or base unit. In a preferred embodiment of the invention, at least three fixed pulleys may be successively fixed on the same horizontal plane as the top end of the bracket.

The driving element vertically hung in the center of the wellhead is connected to a plunger element of a top pump and to a plunger element of a downhole oil well pump. One of the fixed pulleys may be fixed onto the top end of an arm of a positioning bracket of a telescopic positioning wheel, and the bracket of the positioning wheel is articulated to the wellhead side of the bracket and is fixed through a brace. The pump basement may be fixed onto the wellhead with a flange and screws. The locking end of the driving element is connected with a tester; and, the driving element may comprise a flexible cable.

The beneficial effects of this invention include the following: because the pumping system of this invention employs the abovementioned configuration and component elements, by utilizing the characteristics of up and down reciprocal movement of dual pumps on the flexible cable driven by the movable pulley(s) on the crank, the circular motion of the crank can be directly converted into up and down reciprocal motion of the flexible driving body, thereby making it possible for the rigid sucker rod and walking beam of conventional oil field pumping units to be eliminated. This modification reduces the weight of the pumping system and doubles the maximum stroke, hence, during operations, improving pump movement performance, reducing power consumption, increasing the effective load factor, and allowing the oil well pump to realize the desired purpose of lifting. Furthermore, because the structure of the pumping system of the present invention is simple and compact and eliminates the rigid rod, it is possible to reduce the dimensions of the unit, the self weight, and the one-off investment, at the same time. Because the other end of the cable may be connected to the tester, it can carry out an equipment test through the tester without the need to shut down the machine, thereby simplifying the test process. Secondly, by changing the position of the fixed end of the cable and the transmission ratio of the speed reducer, it is possible to perform the operations of adjusting the stroke of the pumping system without shutdown and with a minimal number of stroke adjustments.

It can thus be seen that this invention provides an improved pumping system, in particular, a single-crank, double-stroke, flexible-cable pumping apparatus, which does not need special operational derricks and rigs during operations for replacing the plunger, but rather can execute tripping operations by using its own driving power. During regular operations, the pumping system of this invention not only offers good movement performance, high level of effective load factor, and low power consumption, but also features relatively small unit dimensions and self weight, less one-off investment, ease of parameter adjustments and test operations, and elimination of the rigid sucker rod.

DETAILED DESCRIPTION OF PREFERRED EMBODIMENTS

Figure 1:
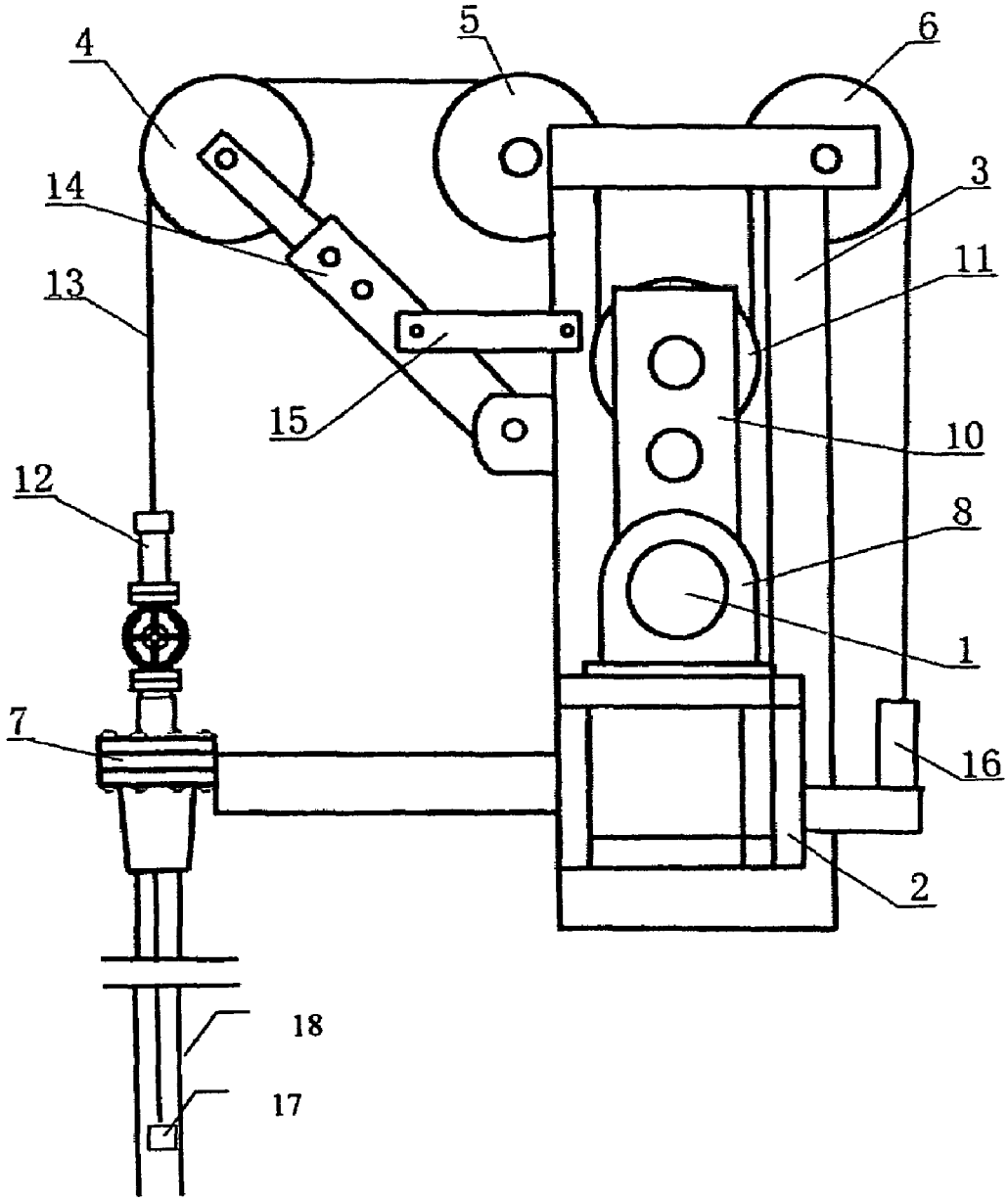
FIG. 1 is a schematic illustration showing the structure of a pumping system according to this invention.

In the drawings and the following Description, the reference numerals identify the following elements of a pumping system in accordance with this invention: 1-electric motor; 2-pump basement or base unit; 3-support bracket; 4-fixed pulley; 5-fixed pulley; 6-fixed pulley; 7-flange; 8-speed reducer; 9-output shaft; 10-crank; 11-movable pulley; 12-top pump; 13-driving element or cable; 14-positioning bracket of positioning wheel; 15-brace; 16-tester; 17-bottom pumping unit; 18-oil tubing.

Figure 2:
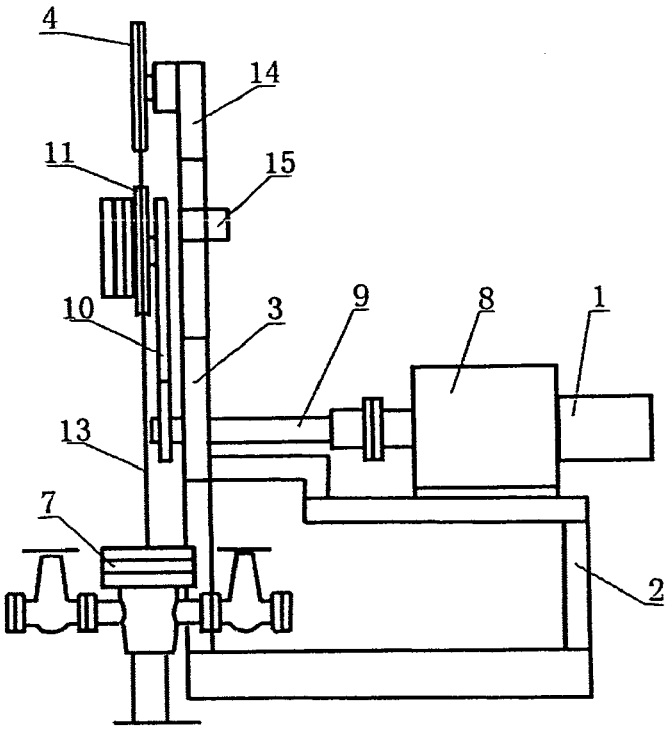
FIG. 2 is a left view of the structure of FIG. 1.
Figure 3:
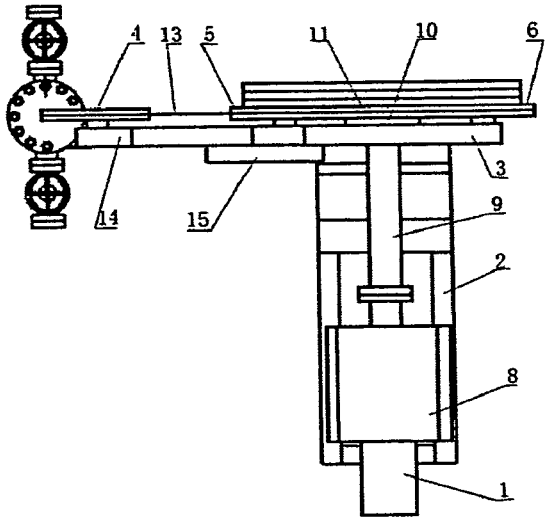
FIG. 3 is a top view of the structure of FIG. 1.

As shown in FIG. 1 in conjunction with FIGS. 2 and 3, the single-crank, double-stroke, flexible-cable pumping system of this invention comprises an electric motor 1, a pump basement or base unit 2, and a flange 7 attached or connected to the basement 2. The flange 7 is located between top and bottom flanges (not numbered) of a wellhead, and fixed to the wellhead for example with screws. A generally L-shaped support bracket 3 is vertically fixed onto a connection end of the basement 2 and also onto the wellhead. The wellhead side of the bracket 3 is preferably articulated with a telescopic positioning wheel bracket 14, that is fixed onto the vertical arm of the bracket 3 by means of a brace 15. By connecting the pump basement 2 to the wellhead, the foundation requirements for the pumping system is dramatically reduced thereby saving on the foundation construction costs for the pumping system. It is possible to adjust the distance between the cable and the outer perimeter of the wellhead in order to center the cable along the vertical axis of the wellhead by using the telescoping feature of positioning wheel bracket 14. The brace 15 connecting wheel bracket 14 to the vertical arm of bracket 3 is used to enhance the stability of the positioning wheel bracket 14. The fixed pulleys 4, 5 and 6 are transversely connected generally in the same plane as the upper ends of the bracket 3 and the positioning wheel bracket 14. The electric motor 1 and a speed reducer 8 are successively fixed on the lower end of the bracket 3. The electric motor 1 and the speed reducer 8 can be connected into same body portion. The end head of an output shaft 9 (see FIGS. 2 and 3) of the speed reducer 8 is connected with a crank 10, and the top end head of the crank 10 is connected with a movable pulley 11 that is generally on the same plane as the fixed pulleys 4, 5 and 6. The flexible cable 13 vertically hung in the center of the wellhead is successively wound across the fixed pulleys 4 and 5, the movable pulley 11 and the fixed pulley 6 and then is locked onto the pump basement 2. By means of the up and down reciprocal motion of dual pumps on the cable 13 driven by the movable pulley 11 on the crank 10, the circular motion of the crank is directly converted into up and down reciprocal motion of the flexible driving body (cable 13). Because this configuration of pumping system elements permits the rigid rod and walking beam of conventional pumping units to be eliminated, it is possible to reduce the load and weight of the pumping system, thereby doubling the maximum stroke, and further improving the movement performance, reducing power consumption, increasing effective load factor, and allowing the oil well pump to better achieve the purpose of lifting oil. The locking end of the cable 13 is preferably connected to a tester 16. This configuration makes it possible to carry out testing of the pumping system through the tester 16 under the condition of no shutdown in order to simplify the test process. Secondly, by changing the length of locking end of the cable 13 and the transmission ratio of the speed reducer 8, it is possible to carry out the operations of adjusting the stroke of the pumping system without shutdown and with a minimal number of stroke adjustments. The cable 13 vertically hung in the center of the wellhead is connected to a plunger element of a top pump 12 in the wellhead and to a plunger element of a downhole oil well pump or bottom pump 17. The plunger element of top pump 12 both seals and helps in creating a partial vacuum to improve the oil production efficiency. Therefore, the pumping system of this invention is a multifunctional pumping unit that has pumping, operating and testing capabilities. Further, the pumping system of this invention not only operates with good movement performance, high level of effective load factor, and low power consumption, but also features relatively small dimensions and self weight of the unit, less one-off investment, ease of parameter adjustments and testing operations, and the elimination of the rigid rods of conventional pumping units.

In one embodiment, the flange 7 may be connected on the basement 2, be located between the big cross joint and the top flange, and be fixed with screws. By adjusting the telescoping rod portion of the positioning wheel bracket 14, it is possible to center the cable 13 to be vertically hung along the vertical axis of the wellhead. The locking end of the cable 13 is connected to the tester 16 that in turn is connected to the pump basement 2. The other end of the cable 13 is wound across the fixed pulley 6, the movable pulley 11 and the fixed pulleys 4 and 5 and then is connected to the plunger element of top pump 12. The cable 13 at the bottom end of the top pump 12 is also connected to the plunger element of a downhole oil well pump. The step of adjusting the stroke involves changing the length of the locking end of the cable 13 and the transmission ratio of the speed reducer 8. With the pumping system of this invention, it is possible to carry out the operations of adjusting the stroke without shutdown and with a minimal number of stroke adjustments. When replacing the plunger of the bottom pump 17, it is necessary to first pull out the top pump by successively using drums to pull out continuously. When installing a replacement plunger of the bottom pump 17, it is necessary to first put in the plunger of the bottom pump 17, and thereafter install the top pump 12.

Although this invention has been described by reference to specific embodiments thereof, it will be understood by those skilled in this art that various changes and modifications may be made in the apparatus components, configuration of the components, and other invention details without departing from the spirit and scope of this invention.

Having described the invention, what is claimed is:

1. A pumping system for a wellhead comprising in combination:

(a) an electric motor;

(b) a pump basement and a support bracket wherein the support bracket is vertically fixed onto a connection end of the basement and also to a wellhead;

(c) multiple fixed pulleys fixed generally in the same plane as the top end of the support bracket;

(d) the electric motor and a speed reducer being successively fixed on a lower end of the support bracket;

(e) an end head of an output shaft of the speed reducer being connected with a pivotable crank pivoted for circular motion when the output shaft is driven by the electric motor;

(f) a top end head of the crank being connected with at least a movable pulley that is movable during operation of the pumping system and that is generally in the same plane as the fixed pulleys;

(g) a flexible driving element vertically hung in said wellhead being successively wound across two of the fixed pulleys, the movable pulley(s), and a third fixed pulley then locked at one end onto the basement; and, (h) another end of the flexible driving element being downwardly connected to a plunger of a wellhead canned pump and to a plunger of a downhole oil well pump such that the circular motion of the crank is directly converted into up and down reciprocal motion of the flexible driving element thereby driving the plungers of the pumps.

2. The pumping system according to claim 1, further wherein said flexible driving element is substantially centered along the vertical axis of the wellhead.

3. The pumping system according to claim 1, further wherein one of the fixed pulleys is fixed onto an end of a telescoping arm of a positioning bracket that is articulated to the wellhead side of the support bracket and is fixed by means of a brace.

4. The pumping system according to claim 1, further wherein said basement is fixed onto the wellhead by means of a connecting flange.

5. The pumping system according to claim 1, further wherein the locked end of said flexible driving element is connected to a tester element.

6. The pumping system according to claim 1, further wherein said flexible driving element is a flexible cable.

7. The pumping system according to claim 6, further wherein said flexible cable is selected from the group consisting of: a wire cable; a non-metal cable; a metal cable; a flexible, pulling-resistant and wear-resistant cable; and a pulling-resistant and wear-resistant strap.

8. The pumping system according to claim 1, further wherein tripping of the plunger of the oil well pump can be provided by its own driving power.

9. A single-crank, double-stroke, flexible-cable pumping apparatus for attachment to a wellhead to assist with pumping a fluid out of a well, said apparatus comprising in combination:

a generally L-shaped support bracket connected to a pump base unit, one arm of which is adapted for connection to a wellhead;

at least two fixed pulleys and at least one movable pulley that is movable during operation of the pumping system in generally the same plane connected directly to the support bracket;

at least one fixed pulley generally in the same plane as the other pulleys connected to one end of a telescoping arm of an adjustable positioning bracket which is connected to the support bracket;

a flexible cable adapted at one end to connect to plungers of wellhead pump units, said cable successively running from a fixed end, engaging a first fixed pulley on the support bracket, engaging a moveable pulley, engaging a second fixed pulley on the support bracket, engaging the fixed pulley on the telescoping arm of the positioning bracket, and terminating in the end adapted to connect to the wellhead pump units; and, an electric motor engaging the movable pulley such that the output of the motor causes circular motion of the movable pulley that is converted into up and down reciprocal motion of the flexible cable thereby driving the plungers of the pumps to operate the pumping apparatus.

10. The pumping apparatus according to claim 9 further comprising a speed reducer in engagement with the electric motor.

11. The pumping apparatus according to claim 9, further wherein said flexible cable is substantially centered along the vertical axis of the wellhead.

12. The pumping apparatus according to claim 9, further wherein the positioning bracket is articulated to the wellhead side of the support bracket and is fixed by means of a brace.

13. The pumping apparatus according to claim 9, further comprising a pump basement wherein said basement is fixed onto the wellhead by means of a connecting flange.

14. The pumping apparatus according to claim 9, further wherein the fixed end of said flexible cable is connected to a tester element.

15. A pumping system comprising:

(a) an electric motor;

(b) a pump basement or base unit, characterized at least in part by the features of a bracket that is vertically fixed on a side of the basement that is connected to a wellhead;

(c) at least two fixed pulleys that are fixed generally in the same plane as a top end of the bracket;

(d) the electric motor and a speed reducer are successively fixed on a lower end of the bracket;

(e) an end head of an output shaft of the speed reducer is connected to a crank;

(f) a top end head of the crank is connected with one or more movable pulleys movable during operation of the pumping system and that are generally in the same plane as the fixed pulleys; and, (g) a flexible driving element that is vertically hung and centered in the wellhead is successively wound across one or more of the fixed pulleys, across one or more of the movable pulleys, and across at least another fixed pulley, before then being locked onto the basement or base unit.

16. The pumping system according to claim 15, further wherein said flexible driving element is selected from the group consisting of: a wire cable; a non-metal cable; a metal cable; a flexible, pulling-resistant and wear-resistant cable; and a pulling-resistant and wear-resistant strap.

17. The pumping system according to claim 15, further comprising wellhead pump units wherein one of the wellhead pump units is an oil well pump and tripping of the plunger of the oil well pump can be provided by its own driving power.

18. A single-crank, double-stroke, flexible-cable pumping system comprising:

(a) an electric motor;

(b) a pump basement or base unit;

(c) a flange attached or connected to the basement, said flange being located between top and bottom flanges of a wellhead and fixed to the wellhead;

(d) a generally L-shaped support bracket vertically fixed onto a connection end of the basement and also onto the wellhead, wherein the wellhead side of the L-shaped support bracket is articulated with a telescopic positioning wheel bracket that is fixed onto a vertical arm of the L-shaped support bracket by means of a brace;

(e) at least three fixed pulleys transversely connected generally in the same plane as upper ends of the L-shaped support bracket and the positioning wheel bracket;

(g) the electric motor and a speed reducer are successively fixed on a lower end of the L-shaped support bracket;

(g) an end head of an output shaft of the speed reducer is connected with a crank;

(h) a top end head of the crank is connected with a movable pulley movable during operation of the pumping system and that is generally in the same plane as the fixed pulleys; and, (i) a flexible cable is vertically hung in the center of the wellhead and successively wound across at least two of the fixed pulleys, then across the movable pulley, then across the third fixed pulley, and then is locked onto the pump basement.

19. The pumping system according to claim 18, further wherein said flexible cable is selected from the group consisting of: a wire cable; a non-metal cable; a metal cable; a flexible, pulling-resistant and wear-resistant cable; and a pulling-resistant and wear-resistant strap.

20. The pumping system according to claim 18, further comprising wellhead pump units wherein one of the wellhead pump units is an oil well pump and tripping of the plunger of the oil well pump can be provided by its own driving power.

* * * * *